US005402876A

United States Patent [19]

Hay

[11] Patent Number: 5,402,876

[45] Date of Patent: Apr. 4, 1995

[54] APPARATUS AND METHOD FOR TRANSPORTING AND METERING PARTICULATE MATERIALS INTO FLUID PRESSURE

[75] Inventor: Andrew G. Hay, Gardena, Calif.

[73] Assignee: Stamet, Inc., Gardena, Calif.

[21] Appl. No.: 116,229

[22] Filed: Aug. 31, 1993

Related U.S. Application Data

[63] Continuation-in-part of Ser. No. 76,314, Jun. 11, 1993, Pat. No. 5,355,993.

[51] Int. Cl.[6] ..... B65G 31/00

[52] U.S. Cl. ..... 198/638; 406/99

[58] Field of Search ..... 198/638, 642; 406/96, 406/99; 415/90, 110, 126

[56] References Cited

U.S. PATENT DOCUMENTS

| | | |
|---|---|---|
| 1,489,571 | 4/1924 | Wright . |
| 1,668,183 | 5/1928 | Albrecht . |
| 2,081,182 | 5/1937 | Malke et al. . |
| 2,712,412 | 7/1955 | West . |
| 2,868,351 | 1/1959 | Hegmann . |
| 3,592,394 | 7/1971 | Sinden . |
| 3,643,516 | 2/1972 | Jacobson . |
| 4,023,784 | 5/1977 | Wallace . |
| 4,076,460 | 2/1978 | Roof . |
| 4,516,674 | 5/1985 | Firth . |
| 4,597,491 | 7/1986 | Conklin . |
| 4,768,920 | 9/1988 | Gurth . |
| 4,773,819 | 9/1988 | Gurth . |
| 4,988,239 | 1/1991 | Firth . |
| 5,051,041 | 9/1991 | Firth . |

*Primary Examiner*—James R. Bidwell

*Attorney, Agent, or Firm*—Spensley Horn Jubas & Lubitz

[57] ABSTRACT

An improved apparatus for transporting and metering particulate material including a transport duct having an inlet, an outlet, and at least one moving surface located therebetween having a downstream facing drive surface. The apparatus further includes drive device for moving the moving surface between the inlet and the outlet towards the outlet, and compacting the particulate material sufficiently to cause the formation of a bridge composed of substantially interlocking particulate spanning the width of the transport duct. The apparatus is used to transport and meter particulate material under ambient conditions and against pressure.

40 Claims, 4 Drawing Sheets

APPARATUS AND METHOD FOR TRANSPORTING AND METERING PARTICULATE MATERIALS INTO FLUID PRESSURE

This application is a continuation-in-part application of an application Ser. No. 08/076,314, filed Jun. 11, 1993, now U.S. Pat. No. 5,355,993.

BACKGROUND OF THE INVENTION

1. Field of the Invention

The present invention relates generally to apparatuses and methods for transporting and metering particulate material and, in particular embodiments, to an improved particulate material handling device which can be used to both transport and meter solid material of a great range of sizes under both ambient conditions and against pressure.

2. Description of Related Art

A wide variety of equipment has been used to either transport or meter particulate material (such as, but not limited to, coal, other mined materials, dry food products, other dry goods handled in solid, particle form). Such transport equipment includes conveyor belts, rotary valves, lock hoppers, screw-type feeders, etc. Exemplary measurement or metering devices include weigh belts, volumetric hoppers and the like. In order to provide both transport and metering of particulate material, it was typically necessary to use or combine both types of devices into a system.

However, some of applicant's prior pump devices were provided with the capability of both transporting and metering particulate material. Examples of such prior designs include the rotary disk type pumps discussed in the following U.S. patents, each of which is assigned or licensed to the assignee of present invention and each of which is incorporated herein by reference: U.S. Pat. No. 4,516,674 (issued May 14, 1985); U.S. Pat. No. 4,988,239 (issued Jan. 29, 1991); and U.S. Pat. No. 5,051,041 (issued Sep. 24, 1991). While some of these prior pump designs have shown some capacity to pump particulate material against a relatively low pressure head, such pumps have not been capable of pumping against a significantly larger gas or fluid pressure head.

There are many instances in which it is desirable to transport and meter particulate materials against pressure (e.g., wherein gas and/or fluid pressure at the output side of the transport system is greater than the gas and/or fluid pressure at the input side of the system). It would be desirable to provide an apparatus which is capable of pumping and metering under both ambient pressure conditions and against a pressure head caused either by entry into a pressurized environment (wherein the gas and/or fluid pressure of the environment on the output side of the apparatus is greater than such at the input side).

A number of factors must be considered in the design of an efficient device for transporting or metering particulate materials. For example, the amount, size and type of particulate material to be transported must be taken into consideration. The distance over which the material is to be transported and variations in the surrounding pressure during transport must also be taken into account. It would be desirable to provide a pump device which is capable of transporting and metering a wide variety of particulate materials under both ambient and pressurized conditions.

Large scale transport and/or metering of particulate material presents unique problems. A transport apparatus or system which is suitable for transporting one type of particulate material may not be suitable for transporting a different type of material. For example, Kentucky coals maintain reasonable integrity when transported through conventional devices such as screw feeders and conveyor belts. However, Western United States coals tend to be more friable and may be degraded to a significant degree during normal transfer operations. It would be desirable to provide an apparatus which is capable of transferring all types of coal (or other friable materials) with a minimum amount of degradation under both ambient and pressurized conditions.

The water content of the particulate solids is another factor which must be considered when designing any transport system. Many transport devices which are suitable for transporting completely dry particles do not function properly when the moisture content of the particulate material is raised. The same is true for particulate metering devices. Conventional metering devices which are designed to measure dry particulates may not be well suited to meter moist solids. It would be desirable to provide a transport apparatus which is capable of moving and/or metering particulate solids regardless of their moisture content under both ambient and pressurized conditions.

It is apparent from the above background that there is a present need for a solids handling or pumping device which operates as a single unit to provide simultaneous transport and metering of particulate material in ambient and pressurized conditions. The unit should be capable of transporting and metering a wide variety of particle types under a wide variety of conditions. Further, the unit should be structurally strong, and mechanically simple and durable so that it can be operated continuously over extended periods of time without failure.

SUMMARY OF THE DISCLOSURE

In accordance with embodiments of the present invention, an apparatus and method is capable of transporting and metering particulate materials against a gas or fluid pressure head, with increased efficiency and reliability. The solids pump according to embodiments of the present invention is particularly suitable for transporting a wide range of particulate materials, including both small and large particulate and mixtures of them, having varying degrees of moisture content.

Particulate material may be transported and metered through a transport duct defined by at least one moving drive surface provided that the particulates have interlocked and bridged across the duct to provide, in effect, a compacted transient solid spanning the width of the duct. The transient solid of interlocked particulates forms a barrier against the pressure head, to inhibit a pressure blow-back through the pump, from the outlet side toward the inlet side. Embodiments of the present invention relate to a transport duct type particulate solids pumping system with an improved ability to pump against a gas or fluid pressure head.

As a result of extensive research and development efforts focussed on higher gas or fluid pressure operations (operations in which the gas or fluid pressure on the output side of the pump is greater than that on the input side of the pump), the inventor has recognized that a number of factors contribute to higher pressure pumping capabilities. This has led to developments, described herein, by which any one or combination of these factors can be affected to improve the ability of a particulate materials pumping system to pump against a gas or fluid pressure head.

For example, the ability of the drive surface to transfer drive force to the moving mass of particles, the ability to inhibit the portion of the transport duct adjacent the drive surface from becoming pressurized, the configuration and length of the duct, each have been found to contribute to the ability of the apparatus to pump against a gas or fluid pressure head. Thus, various embodiments of the invention provide means for improving the transfer of drive force to the particles. Further embodiments provide means for inhibiting pressurization of the transport duct, and further embodiments provide apparatus dimensions and configurations for improved pressure operations.

According to one embodiment for improving the transfer of drive force, the moving drive surface has at least one discontinuity having a downstream facing drive surface. The discontinuity defines a transport facilitation zone which improves the ability of the drive surface to interlock with the interlocked particulates of the transient solid. In further embodiments a plurality of discontinuities, such as a plurality of evenly spaced discontinuities, are provided on the drive surface.

The improved interlocking of the transient solid with the drive surface, in turn improves the ability of the particulates forming the transient solids to bridge. The improved bridging results in an improved pressure barrier formed by the bridged particulates. Successive bridges occur cumulatively within the transport duct as further particulate material enters the inlet. This cumulative bridging may occur without the use of chokes or dynamic relative disk motion. However, further embodiments may include chokes or dynamic relative disk motion. Examples of such chokes and disk motions are described in U.S. Pat. No. 5,051,041; U.S. Pat. No. 4,988,239 and U.S. Pat. application No. 07/929,880 (each of which are assigned or licensed to the assignee of the present application and each of which are incorporated herein by reference).

According to further embodiments of the invention, the shape and dimension of the outlet duct is designed to retain a moving mass of particles therein during the pumping operation, such that the moving mass of particles function as a dynamic plug against gas or fluid pressure on the outlet side of the apparatus. Further embodiments employ venting means by which pressure may be vented from the outlet duct or the drive channel.

The above discussed and many other features and attendant advantages of the present invention will become better understood by reference to the following detailed description when considered in conjunction with the accompanying drawings.

DETAILED DESCRIPTION OF THE PREFERRED EMBODIMENTS

The following detailed description is of the best presently contemplated mode of carrying out the invention. This description is not to be taken in a limiting sense, but is made merely for the purpose of illustrating general principles of embodiments of the invention. The scope of the invention is best defined by the appended claims.

In accordance with preferred embodiments of the present invention, apparatus and methods for transporting and metering particulate materials are provided with an improvements relating to the ability to pump against a gas or fluid pressure with increased efficiency and reliability. Embodiments may be used for transporting a wide range of particulate materials, including both small and large particulate and mixtures of them, having varying degrees of moisture content, under both ambient and pressurized conditions.

As a result of extensive research and development efforts focussed on higher gas or fluid pressure operations (operations in which the gas or fluid pressure on the output side of the pump is greater than that on the input side of the pump), the inventor has recognized that a number of factors contribute to higher pressure pumping capabilities. This has led to developments, described herein, by which any one or combination of these factors can be affected to improve the ability of a particulate materials pumping system to pump against a gas or fluid pressure head.

For example, the ability of drive surfaces to transfer drive force to a moving mass of particles, the ability to inhibit pressurization of the transport duct in the apparatus, and the configuration and length of the transport duct, each have been found to contribute to the ability of the apparatus to pump against a gas or fluid pressure head. Thus, various embodiments of the invention provide means for improving the transfer of drive force to the particles. Further embodiments provide means for inhibiting pressurization of the transport duct, and further embodiments provide apparatus dimensions and configurations for improved pressure operations.

A general discussion of an embodiment of rotary disk-type apparatuses for transferring particulate material is provided below. In addition, a description of features for improved pressure operations is provided with reference to the rotary disk-type apparatus structure. However, it will be recognized that various features and aspects of the invention may be employed with particulate pumps having a configuration other than the rotary disk configuration. For example, various features and aspects of the invention may be employed in any suitable particulate transferring apparatus having at least one moveable drive surface defining a transport duct in which particulate material is moved.

Figure 1:
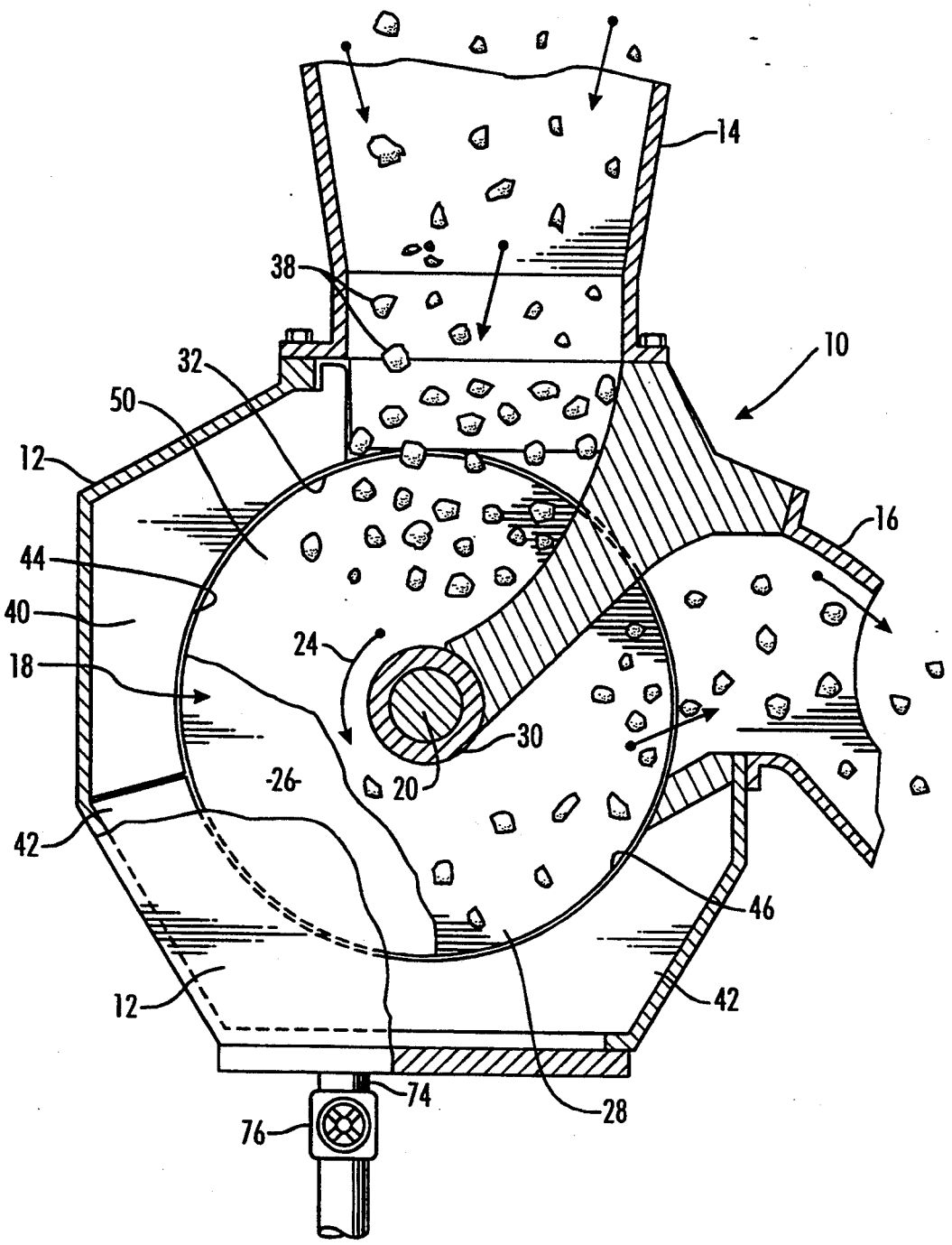
FIG. 1 is a partial sectional side view of a first preferred exemplary apparatus, with an improved ability to pump against gas or fluid pressure, in accordance with an embodiment of the present invention.

A first preferred exemplary apparatus in accordance with an embodiment of the present invention is shown generally at 10 in FIG. 1. The apparatus 10 includes a housing 12, an inlet 14, and outlet 16. Various improvements in the inlet are described in the co-pending U.S. patent application titled "APPARATUS WITH IMPROVED INLET AND METHOD FOR TRANSPORTING AND METERING PARTICULATE MATERIAL" filed Aug. 31, 1993 (attorney docket no. PD-2985) (Ser. No. 08/115,173), which is assigned to the assignee of the present invention and which is incorporated herein by reference.

Located within housing 12 is drive rotor 18. The drive rotor 18 is mounted on shaft 20, with shaft 20 being rotatably mounted within a conventional low-friction bearing assembly (not shown) for rotation about the axis of shaft 20. The shaft 20 is connected to a hydrostatic or electrically-driven motor (not shown). The shaft 20 is driven by the motor in the direction shown by arrow 24 in FIG. 1.

Figure 2:
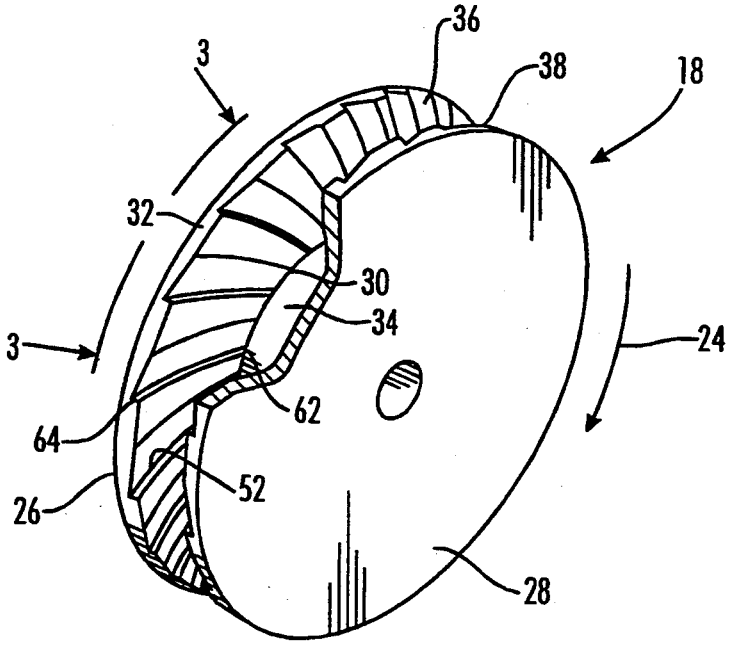
FIG. 2 is a perspective cut away view of the drive rotor of the preferred exemplary apparatus shown in FIG. 1 showing preferred exemplary discontinuities on opposing interior surfaces of parallel rotary disks.
Figure 3:
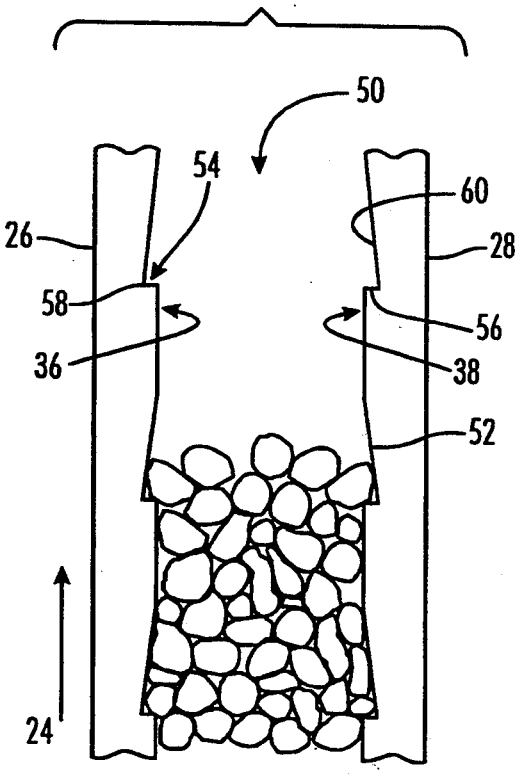
FIG. 3 is a partial sectional transverse view of the drive rotor shown in FIG. 2 taken in the 3—3 plane showing particulate bridging between and interlocking with opposing interior faces of the rotary disks.

As best shown in FIGS. 2 and 3, the drive rotor 18 includes rotary disks 26 and 28, having inner diameters 30 and outer diameters 32, and hub 34. Preferably, the drive rotor is made up of two separate rotary disks in order to facilitate assembly of the solids pump.

Rotary disks 26 and 28 include opposing interior faces 36 and 38. Opposing interior faces 36 and 38 are not planar but rather include a plurality of evenly spaced radially extending discontinuities 52. Each discontinuity 52 defines a transport facilitation zone 54 having a downstream facing drive surface 56, a bottom area 58 and an upstream facing surface 60.

As best shown in FIGS. 2 and 3, downstream facing drive surfaces 56 are perpendicular to interior faces 36 and 38 and backwardly curving such that trailing end 64 extends away from outlet 16 relative leading end 62 as rotary disk 26 moves between inlet 14 and outlet 16. This backwardly curving configuration facilitates discharge of particulate at outlet 16.

In the preferred embodiment shown in FIGS. 2 and 3, the width of transport facilitation zones 54 increase as transport facilitation zones 54 extend from inner diameter 30 to outer diameter 32. Upstream facing surfaces 60 of each rotary disk incline upwardly from bottom area 58 to the interior face of the rotary disk.

Opposing interior faces 36 and 38 are positioned opposite each other in order to provide surfaces between which the particulate solids are compacted. Preferably, the discontinuities 52 of opposing interior faces 36 and 38 are aligned to define a symmetric channel for transport of particulate as best shown in FIG. 3. This symmetric configuration mitigates against uneven loadings on the bearing assembly (not shown) supporting drive rotor 18 during compaction and transport of particulate.

The preferred exemplary apparatus 10 includes one or more exterior shoes such as those shown in FIG. 1 at 40 and 42. The exterior shoes 40 and 42 are designed to close the primary transport channel formed between interior faces 36 and 38 of the drive rotor 18. Each of the exterior shoes 40 and 42 includes a stationary inner wall 44 and 46, respectively. Inner walls 44 and 46, in combination with hub 34 and opposing interior faces 36 and 38, define the cross-sectional area of the primary transport channel 50 at any given point. Both exterior shoes 40 and 42 are mounted to the housing by way of suitable mounting brackets or pins. The inner wall, or inner walls in the case of plural shoes, are accurately formed so as to conform to the circular perimeter of the rotary disks 26 and 28. Therefore, as the rotary disks 26 and 28 rotate with the shaft 20, the stationary wall of the shoe keeps the particulate matter being transported between the opposing interior faces 36 and 38. In one preferred embodiment, the inner wall of the shoe extends axially (transversely of the shoe) beyond interior surfaces 36 and 38, respectively, of the drive rotor 18 so as to overlap the interior surfaces 36 and 38 of the drive rotor. The shoe is placed as close as possible, within acceptable tolerances, to the outer diameters 32 of interior faces 36 and 38. In this configuration, the shoe is not radially adjustable to move closer or further away from the hub 34 of the drive rotor 18 to change the cross-sectional area of the primary transport channel 50.

In an alternative embodiment, the shoe may be axially sized and shaped so as to fit between opposing interior faces 36 and 38 to form a curved outer wall for the primary transport channel 50. In this configuration, the radial location of the shoe may be adjusted toward or away from the hub 34 of the drive rotor 18 so as to change the cross-sectional area of the primary transport channel 50. For this purpose, a screw adjuster may be connected to one or a plurality of shoes as shown in U.S. Pat. No. 4,988,239 (incorporated herein by reference). The screw adjuster 50 shown there provides radially inward and outward adjustment of shoe 40 about a pivot pin 48. The inward and outward adjustment of shoe 40 allows setting up a choking or compaction of the solids as they move through the pump or, alternatively, to provide a diverging or a constant cross-sectional area along the duct. A second screw adjuster 54 may be attached to a second shoe 42 shown in the '239 patent. The second screw adjuster is of the same type as the first and is provided to allow inward and outward radial adjustment of shoe 42. The inward and outward adjustment of shoe 42 would allow the size of the duct to be varied as the solids move through the pump after passing the first shoe 40 substantially independently of the angle of the second disk 26. In further embodiments, a single stationary wall may be provided, instead of the shoes 40 and 42 and shoe walls 44 and 46.

In a preferred embodiment of the present invention (not shown), compaction of articulates is accomplished by providing means for positioning rotary disk 26 at an angle relative to rotary disk 28 such that the distance between the opposing interior faces 36 and 38 adjacent the inlet 14 is greater than the distance between opposing interior faces 36 and 38 between inlet 14 and outlet 16. (Alternatively, the disks may be angled relative to each other to define a diverging duct from the inlet to the outlet.) In this configuration, the cross-sectional area of the transport duct decreases (or increases, in the diverging embodiment) as the distance between the opposing interior faces decreases (or increases) thereby providing a convergence or choke (or divergence) in the transport duct. Preferably, means are also included to vary the angle at which the rotary disks rotates relative to each other. Variation of the angle modifies the rate of change of the cross-sectional area between the inlet and the outlet to provide a different convergence or choke (or divergence) in the duct. Various aspects of the foregoing and alternative preferred arrangements for accomplishing compaction are more fully described in U.S. Pat. application Ser. No. 07/929,880 which is incorporated herein by this reference.

In another preferred embodiment of the present invention (not shown), means for vibrating particulate material adjacent inlet 14 are provided to facilitate compaction and to permit and cause flow of particulate material. In some applications, the use of vibrating means at inlet 14 may provide sufficient compaction for pump operation. In other applications, the pressure head developed by gravitational forces exerted on particulate at inlet 14 may provide sufficient compaction for operation of the pump in which case no additional compaction would be necessary.

Figure 5:
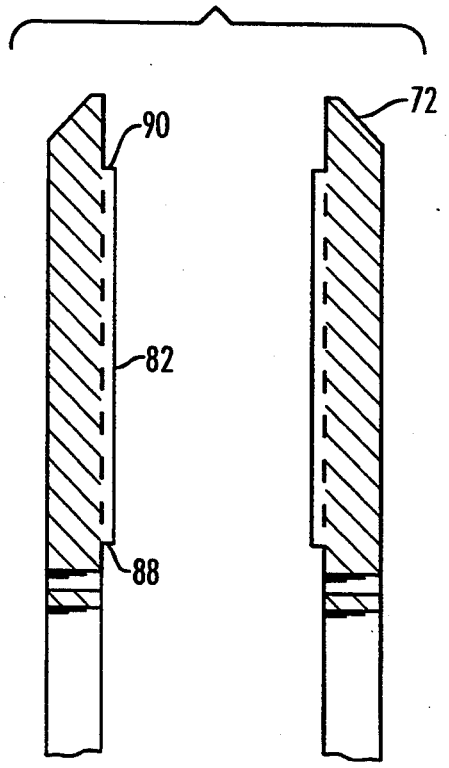
FIG. 5 is a partial sectional transverse view of the rotary disk shown in FIG. 4 taken in the 5—5 plane.

As best shown in FIG. 3, the compaction of particulate material results in the formation of a transient solid or bridge composed of substantially abutting or interlocking particulate spanning the width of primary transport channel 50 and including particulate compacted within transport facilitation zones 54. The bridge of particulate is engaged by downstream facing drive surfaces 56 upon rotation of rotary disks 26 and 28 and transported towards outlet 16. In order to preclude particulate and particulate dust from wedging in the space defined between the housing 12 and the outer edge of each rotary disk 26 and 28, the rotary disks include a chamfer 72 as best shown in FIG. 5 which inclines away from housing 12 as the outer edge extends outward from the interior face of the rotary disk. Preferably, the outer edge is chamfered at an angle of about 45 degrees.

A dust drain 74 with an associated valve 76 is provided at the bottom of the housing for allowing removal of dust which may accumulate during pump operation. The valve 76 may be left open during pump operation to continually remove dust as it falls into the drain through an interior collection channel(not shown). Alternatively, the valve 76 may be left closed, and only opened when the interior collection channel has filled with dust. The opening and closing of the valve 76 will, of course, depend upon the dustiness or friability of the particular solid material being transported.

The size of the drive rotor 18 may vary widely, depending upon the type and volume of material which is to be transported or metered. Typically, outside diameters for the rotary disks 26 and 28 may range from a few inches to many feet. The smaller rotary disks are well suited for use in transporting and metering relatively small volumes of solid material such as food additives and pharmaceutical. The larger size disks may be utilized for transporting and metering large amounts of both organic and inorganic solid materials, including food stuffs, coal, gravel and the like. The apparatus is equally well suited for transporting and metering large and small particles and mixtures of them, and large and small volumes, and may be used to transport and meter both wet and dry particulate material with the only limitation being that the material cannot be so wet that viscous forces dominate so as to disturb bridging.

Figure 4:
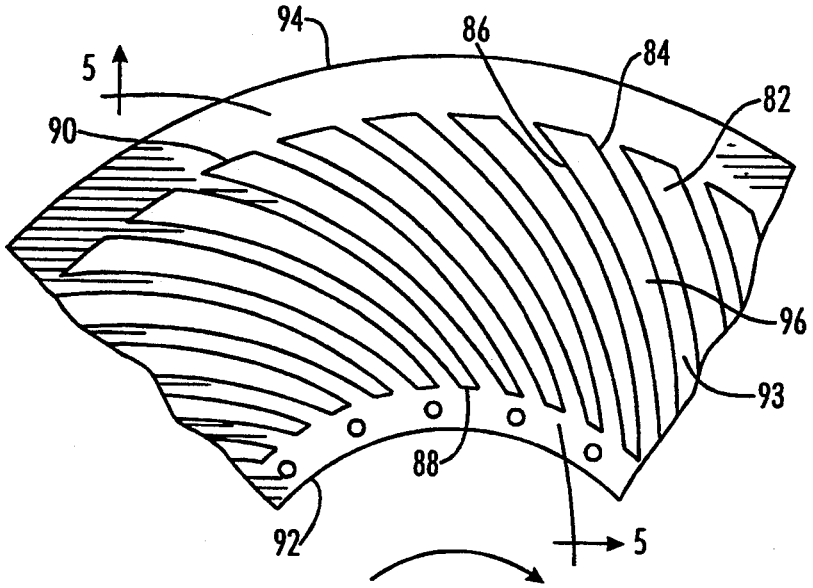
FIG. 4 is a plan view of a second preferred exemplary rotary disk.

The configuration of discontinuities on the opposed interior surfaces 36 and 38 may vary substantially in accordance with the present invention. In the preferred embodiment of rotary disks shown in FIGS. 4 and 5, the opposing interior faces 36 and 38 of each rotary disk include as discontinuities a plurality of evenly spaced radially extending upraised portions 82, each having a downstream facing drive surface 84 and an upstream facing surface 86 located upstream of the downstream facing drive surface 84, each of which is substantially perpendicular to the interior face of the rotary disk. The upraised portions 82 also include an inner surface 88 and an outer surface 90, both of which are contiguous with a downstream facing drive surface 84 and an upstream facing surface 86 and which are substantially perpendicular to the interior face of the rotary disk. The inner surface 88 is positioned outward of the inner diameter 92 of the rotary disk and is substantially perpendicular to the radial component which intersects therewith. The outer surface go is positioned inward of the outer diameter 94 of the rotary disk and is substantially perpendicular to the radial component which intersects therewith. The upraised portion 82 also includes a top surface 96 which is substantially parallel to the interior face of the rotary disk. The width of each top surface 96 expands as the top surface 96 extends from near the inner diameter 92 to near the outer diameter 94 of the rotary disk such that the width of the recess 98 defined by adjacent upraised sections 82 remains constant as the recess 98 extends from near the inner diameter 92 to near the outer diameter 94. The upraised portion 82 is backwardly curving such that the outer surface 90 extends away from outlet 16 relative to inner surface 88 as the rotary disk moves between inlet 14 and outlet 16.

Alternatively, opposing interior faces may include radially extending undulations defining a wave-like series of alternating crests and troughs. Further embodiments may employ simple ridges or grooves in the disk walls.

The apparatus in accordance with embodiments of the present invention may be utilized for transporting particulate material against atmospheric pressure. In addition, the pump has been found useful in pumping solids into pressurized systems (e.g., wherein the pressure at the outlet side of the apparatus is greater than the pressure at the inlet side of the apparatus, or vice versa). Referring to FIGS. 1 and 2, it is preferred when pumping solids into pressurized systems that the entire cross-sectional area of outlet 16 be filled with solids during pumping. This forms a dam at the pump outlet which is a barrier to possible deleterious effects of reverse flow of gases, liquids or solids back into the pump through the outlet. The cumulative bridging of the particulate provides a sequentially formed cascaded reinforcement which adds strength to the particle bridge portions closer to the outlet, such that the bridge portions closer to the outlet will be strong enough to withstand the higher pressure at the outlet side of the apparatus.

The duct length is preferably designed such that a sufficient amount of cumulative, cascaded bridging occurs in the duct to support and withstand the higher pressure at the outlet side of the pump. This can be accomplished with a convergent duct, constant cross-section duct or divergent duct system. It is interesting to note that prior to the present invention, it was not believed to be practical or possible to pump solids into a higher pressure outlet side with a divergent duct system.

The improved interlocking of the transient solid with the drive surfaces (e.g., the drive walls having grooves or other discontinuities), in turn improves the ability of the particulates forming the transient solids to bridge. In particular, the mass of interlocked particles forming the transient solid becomes interlocked with the surface discontinuities in the drive walls, as shown in FIG. 3, which results in an improved transfer of drive force and, therefore, an improved ability of the particulates to bridge. The improved bridging results in an improved pressure barrier formed by the bridged particulates.

The orientation and configuration of the output duct of the pump also affects the ability to transfer particulate solids into higher pressure on the output side relative to the input side. For example, further improvements in the ability and efficiency of operation for pumping into pressurized systems are achievable with the an upwardly facing outlet duct, such as shown at 102 in the apparatus 100 in FIG. 6 (the same reference numerals are used for elements similar to those used in the apparatus shown in FIG. 1).

An end portion 104 of the outlet duct 102 is coupled to a pressurized system 106. Preferably, the outlet duct 102 faces upward (i.e., the end of the outlet duct coupled to the pump is lower than the opposite end of the outlet duct) so that particulate material is driven upward before being discharged from the outlet duct 102 into the pressurized system 106. As a result of the upward directed wall or walls of outlet duct 102, the duct, in effect, forms a receptacle which holds particulate material as the particulate material is moved through the outlet duct.

The moving particulate material held within the walls of the outlet duct at any instant during the pumping operation is acted upon by the drive force of the pump, as additional particulate material is driven into the lower end of the outlet duct. At the same time, gravity and gas or fluid pressure on the outlet side acts on the particulate material held within the outlet duct walls. The moving particulate material held within the outlet duct at any given instant during the pumping operation is, therefore, compacted and tends to fill the outlet duct interior. As a result, the particulate material forms, in effect, a moving or dynamic plug which inhibits the passage of gas or liquid into the drive duct of the pump from the outlet side.

Furthermore, greater compaction or compression tends to occur toward the lower end of the outlet duct (i.e., nearer to the drive duct), which tends to further strengthen the particulate bridge portions in the primary transfer channel or drive duct 50, which in turn tends to increase the ability of the pump to transfer drive force to the transient mass. As a result of this cumulative affect outlet duct 102, the overall system can operate against a significantly higher pressure on the outlet side of the pump relative to the inlet side of the pump.

This cumulative affect is further enhanced by such drive force improvement features as discussed above (e.g., with respect to embodiments of drive walls having discontinuities) and as used in the co-pending U.S. patent application titled "APPARATUS AND METHOD WITH IMPROVED DRIVE FORCE CAPABILITY FOR TRANSPORTING AND METERING PARTICULATE MATERIAL" filed Aug. 31, 1993, (attorney docket no. PD-2986) (Ser. No. 08/115,177), which is assigned to the assignee of the present invention and which is incorporated herein by reference. That is, the improved ability to transfer drive force results in an improved bridging and an improved transfer of particulate material into the outlet duct, which, in turn, results in an improved dynamic plug and, thus, a further improved ability to pump against pressure. Thus, the improved ability to transfer drive force to the particulate material and the improved outlet duct configuration and/or orientation cooperate with each other in a cumulative and synergistic manner to provide a greatly improved apparatus for pumping against pressure.

In preferred embodiments, the outlet duct 102 has an outwardly diverging cross-section (diverges in the direction from the end coupled to the transfer channel or drive duct 50 toward the end 104 coupled to the pressurized system 106). Because the cross-section of the outlet duct 102 gradually diverges toward the end portion 104, the particulates become less compacted toward the end portion 104 of the outlet duct 102. As a result, the force of the particulate on the internal surface of the outlet duct wall 105, and therefore the friction between the particulate material and the wall 105, reduces toward the outlet duct end portion 104. As a consequence, while the capacity to withstand the higher pressure is improved by the upwardly facing outlet 102, the drive force of the apparatus 100 for driving the particulate matter through the outlet duct need not be substantially increased.

The length of the outlet duct 102 is preferably designed such that a sufficient amount material will be held in the outlet duct 102 at any instant during the pumping operation, to support and withstand the higher pressure. Since particulate material which is carried through the outlet duct 102 exerts pressure on the internal surface of the wall 105, the internal surface of the wall 105 should preferably be coated, to reduce friction between particulate material and the wall 105, with a low friction material, such as for example, polytetrafluoroethylene, and other ultra-high molecular weight materials.

Alternatively, the drive force of the apparatus 100 may be increased so that the particulate material can be moved against greater frictional resistances at the upwardly facing outlet. As a result, a stronger cascaded reinforcement of particulate material may be formed to withstand higher pressures of the pressurized system.

As apparent from the above discussion, the shape and orientation of the outlet duct 102 can have dramatic affects on the ability and efficiency of the apparatus to move particulate material against a pressure head, including a gas or fluid pressure head. Accordingly, the shape and orientation of the outlet duct is preferably selected to provide the optimal pressure handling capabilities for a particular pumping operation.

It has been found that further improvements in the ability to operate against a gas or fluid pressure head are achieved by inhibiting the drive duct or channel from becoming pressurized (containing a greater gas or fluid pressure than the pressure on the inlet side of the apparatus). Accordingly, further embodiments of the invention provide for the minimization of pressure leakage from the higher pressure outlet side of the apparatus into the drive duct or channel 50. Venting of pressure at various locations along the outlet duct and/or the drive channel or duct may minimize or inhibit the pressurization of the drive channel or duct 50. Examples of such venting arrangements are discussed below.

According to a further embodiment, the apparatus 100 is provided with a non-return valve system for preventing pressurized gas or fluid of the pressurized system 106 from entering into the apparatus 100 when the apparatus 100 runs short or out of particulate material to pump out. For example, in a preferred embodiment, a valve plate 108, pivotal about a pin 110, is provided adjacent the external end portion 104 of the outlet 102. Particulate material being discharged from the outlet 102 pushes against the valve plate 108 to open the valve plate 108 during a normal pumping operation. On the other hand, when the apparatus 100 runs short or out of particulate material, the valve plate 108 closes the outlet 102 to inhibit the pressurized gas or fluid from entering into the primary transport channel 50 of the apparatus 100.

In another embodiment, pressure sensor devices (not shown) may be provided to monitor the pressure in the primary transport channel 50 and/or in the outlet duct 102. Monitored pressure may be used to control a servomotor system or other suitable motor (not shown) coupled to the valve plate 108 for opening and closing of the valve plate 108 so that the pressurized gas or fluid does not enter into the primary transport channel 50 when the apparatus runs out of particulate material.

As discussed above, particulate solids are substantially compacted in the outlet 102 during pumping, and form a sequentially moving cascaded bridging of particulate solids or a moving dynamic plug through the outlet 102 to act as a seal (or partial seal) against the pressurized fluid of the pressurized system 106. However, the fluid, gas or liquid, may still be able to seep through minute paths formed between particulate solids, and possibly into the inlet 14.

Figure 6:
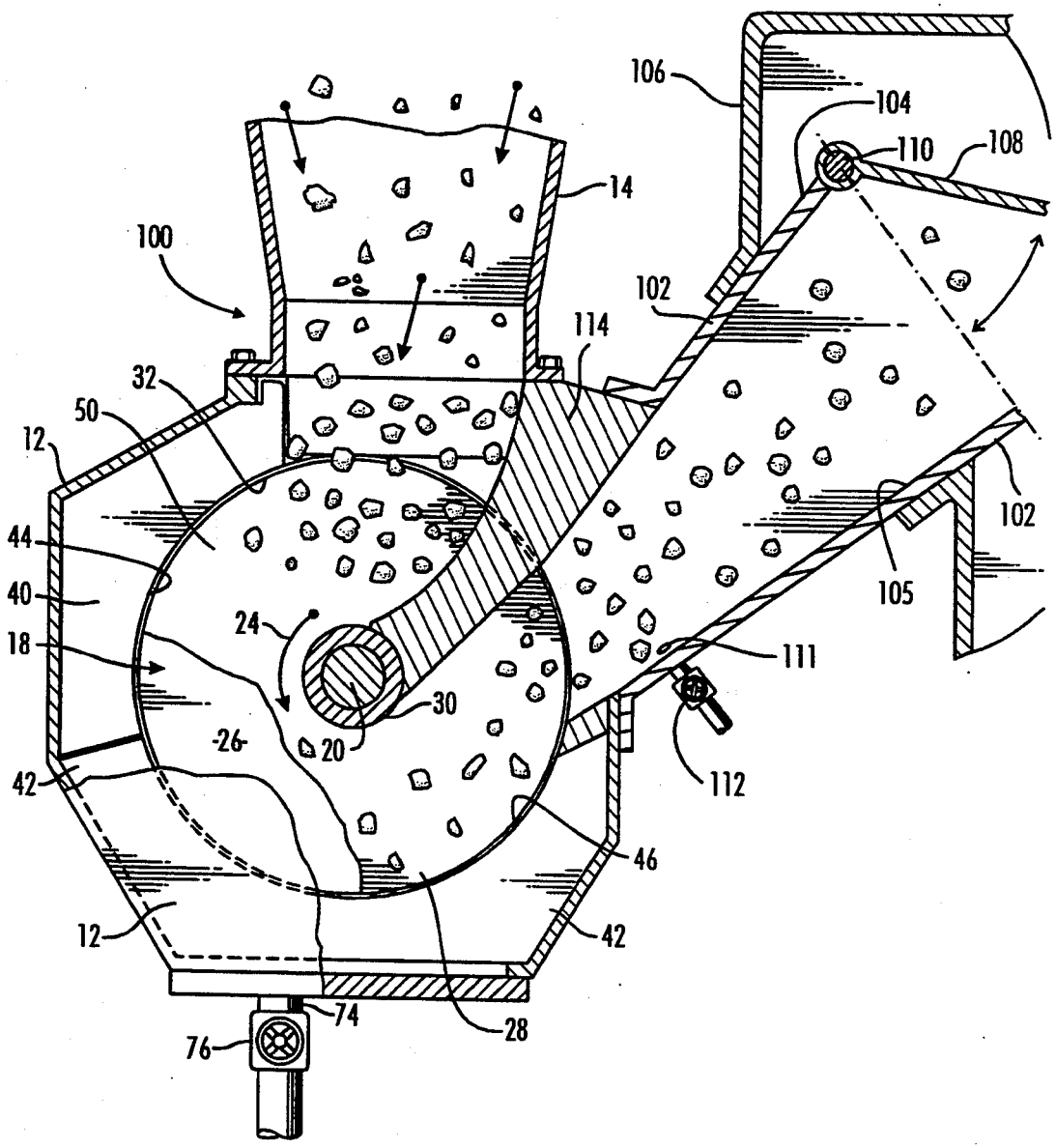
FIG. 6 is a partial sectional side view of a second preferred exemplary apparatus, with an improved ability to pump against gas or fluid pressure, in accordance with another embodiment of the present invention.

As mentioned above, to inhibit or prevent the fluid from seeping into the inlet 14, the apparatus 100 may be provided with a vent system for venting fluid pressure. For example, as shown in FIG. 6, a vent 111 is provided in the outlet 102 adjacent the primary transport channel 50 (the vent 111 may be arranged closer to the channel 50 than as shown in FIG. 6), or on the housing or shoes adjacent the periphery of the rotary disks 26 and 28. The vent 111 may be coupled to a pump device (not shown) to pump out the fluid seeping through the particulate solids. Alternatively, the pressure of the fluid itself may be enough to operate the vent. Preferably, the vent 111 is provided with a valve 112 for selectively closing or opening the vent 111. The vent system may be provided at any suitable location along the primary channel 50. For example, a vent may be provided at the exterior shoe 42, or at an abutment member 114. In further preferred embodiments, gaps between the disks and the housing, shoes or the hub may provide suitable venting outlets.

Although the preferred exemplary embodiments have been shown utilizing a single drive rotor, it is also possible to provide transport apparatus having multiple drive rotors which receive material from a single or multiple inlets. The use of multiple drive rotors provides for increased material through-put without having to increase the diameter of the rotor disk.

The bridging of solids results in a positive displacement of the solids. Accordingly, the pump may be used both as a transport and metering device. Due to the positive displacement of solids through the pump, metering is accomplished by measuring the rate of rotation of the drive rotor and calculating the amount of solids flow through the pump based upon the cross-sectional area of the duct. When used as a metering pump, it is desirable that some type of conventional detection device be utilized to ensure that the passageway remains full of solids at all times during solids metering. Such conventional detection devices include gamma ray and electro-mechanical detectors. These detectors are all well known in the art and are neither shown in the drawings nor described in detail.

The apparatus elements are preferably made of high strength steel or other suitable material. The interior surfaces of drive disks and the interior walls of the shoes are preferably made of an abrasion-resistant metal or other suitable material having non-adhesive qualities to facilitate discharge at the outlet during operation and to facilitate cleaning during maintenance. In suitable applications, the interior surfaces of the rotary disks and the interior wall of the shoes may be composed of a low friction material, such as polytetrafluoroethylene.

Having thus described exemplary embodiments of the present invention, it should be understood by those skilled in the art that the above disclosures are exemplary only and that various other alternatives, adaptations and modifications may be made within the scope of the present invention. For example, although a drive rotor is a preferred form of a moving surface, it is not essential. Any type of movable surface, conveyor belt or other system may be utilized so long as the bridging and a downstream facing-drive surface features are provided.

The presently disclosed embodiments are to be considered in all respects as illustrative and not restrictive. The scope of the invention being indicated by the appended claims, rather than the foregoing description, and all changes which come within the meaning and range of equivalency of the claims are, therefore, intended to be embraced therein.

What is claimed is:

1. An apparatus for transporting particulate material against a fluid pressure comprising:

a first moveable surface defining a transport channel, an inlet and an outlet downstream of said inlet, said transport channel located between said inlet and said outlet, the first movable surface operable to move from said inlet towards said outlet;

an outlet duct defining a receptacle having an interior outlet channel which extends upward from the outlet of the transport channel and defines a cross-sectional area which diverges in the upward direction for holding, during the operation of the apparatus, a mass of the particulate material being transferred by the apparatus, so as to form a moving dynamic plug for inhibiting fluid from entering the primary transport channel from the outlet duct.

2. An apparatus for transporting particulate material according to claim 1, further comprising drive means for moving said first moveable surface between said inlet and said outlet towards said outlet.

3. An apparatus for transporting particulate material according to claim 1, wherein said outlet duct has a bottom end portion adjacent said transport channel, an external end portion opposed to said bottom end portion, and an upwardly inclined internal wall.

4. An apparatus for transporting particulate material according to claim 1, wherein said primary transport channel is further defined by a second moving surface substantially opposed to said first moving surface, said second moving surface being moveable between said inlet and said outlet toward said outlet.

5. An apparatus for transporting particulate material according to claim 4, wherein said first moving surface comprises a first face of a first rotary disk and said second moving surface comprises a second face of a second rotary disk and said transport channel is further defined by at least one arcuate wall extending between said inlet and said outlet.

6. An apparatus for transporting particulate material according to claim 1, wherein said outlet duct has an internal wall, said internal wall which is coated with a low friction material.

7. An apparatus for transporting particulate material according to claim 6, wherein said low friction material is polytetrafluoroethylene.

8. An apparatus for transporting particulate material against a fluid pressure comprising:

a first movable surface defining a transport channel, an inlet and an outlet downstream of said inlet, said transport channel located between said inlet and said outlet, the first moving surface operable to move from said inlet towards said outlet;

an outlet duct defining a receptacle for holding, during the operation of the apparatus, a mass of the particulate material being transferred by the apparatus, so as to form a moving dynamic plug for inhibiting fluid from entering the primary transport channel from the outlet duct;

wherein said outlet duct has a bottom end portion adjacent said transport channel, an external end portion opposed to said bottom end portion, and an upwardly inclined internal wall; and wherein said internal wall of said divergent receptacle defines a divergent receptacle having a cross-section which diverges in the direction away from said transport channel.

9. An apparatus for transporting particulate material against a fluid pressure comprising:

a first movable surface defining a transport channel, an inlet and an outlet downstream of said inlet, said transport channel located between said inlet and said outlet, the first moving surface operable to move from said inlet towards said outlet;

an outlet duct defining a receptacle for holding, during the operation of the apparatus, a mass of the particulate material being transferred by the apparatus, so as to form a moving dynamic plug for inhibiting fluid from entering the primary transport channel from the outlet duct; and wherein said outlet duct has an internal wall defining a divergent receptacle having a cross-section which diverges in the direction away from said transport channel.

10. An apparatus for transporting particulate material against a fluid pressure comprising.:

a first movable surface defining a transport channel, an inlet and an outlet downstream of said inlet, said transport channel located between said inlet and said outlet, the first moving surface operable to move from said inlet towards said outlet;

an outlet duct defining a receptacle for holding, during the operation of the apparatus, a mass of the particulate material being transferred by the apparatus, so as to form a moving dynamic plug for inhibiting fluid from entering the primary transport channel from the outlet duct; and wherein the outlet duct is coupled to the transport channel at an outlet junction, the apparatus further comprising a pressure vent provided adjacent the outlet junction.

11. An apparatus for transporting particulate material against a fluid pressure comprising:

a first movable surface defining a transport channel, an inlet and an outlet downstream of said inlet, said transport channel located between said inlet and said outlet, the first moving surface operable to move from said inlet towards said outlet;

an outlet duct defining a receptacle for holding, during the operation of the apparatus, a mass of the particulate material being transferred by the apparatus, so as to form a moving dynamic plug for inhibiting fluid from entering the primary transport channel from the outlet duct; and further comprising a pressure vent in said transport channel.

12. An apparatus for transporting particulate material against a fluid pressure comprising:

a first movable surface defining a transport channel, an inlet and an outlet downstream of said inlet, said transport channel located between said inlet and said outlet, the first moving surface operable to move from said inlet towards said outlet;

an outlet duct defining a receptacle for holding, during the operation of the apparatus, a mass of the particulate material being transferred by the apparatus, so as to form a moving dynamic plug for inhibiting fluid from entering the primary transport channel from the outlet duct;

wherein said primary transport channel is further defined by a second moving surface substantially opposed to said first moving surface, said second moving surface being movable between said inlet and said outlet toward said outlet; and wherein each of said first and second movable surfaces has at least one undulation defining a downstream facing drive surface for engaging particulate material.

13. An apparatus for transporting particulate material against a fluid pressure comprising:

a first movable surface defining a transport channel, an inlet and an outlet downstream of said inlet, said transport channel located between said inlet and said outlet, the first moving surface operable to move from said inlet towards said outlet;

an outlet duct defining a receptacle for holding, during the operation of the apparatus, a mass of the particulate material being transferred by the apparatus, so as to form a moving dynamic plug for inhibiting fluid from entering the primary transport channel from the outlet duct; and wherein said first movable surface has at least one undulation defining a downstream facing drive surface for engaging particulate material.

14. An apparatus for transporting particulate material against a fluid pressure comprising:

a first movable surface defining a transport channel, an inlet and an outlet downstream of said inlet, said transport channel located between said inlet and said outlet, the first moving surface operable to move from said inlet towards said outlet;

an outlet duct defining a receptacle for holding, during the operation of the apparatus, a mass of the particulate material being transferred by the apparatus, so as to form a moving dynamic plug for inhibiting fluid from entering the primary transport channel from the outlet duct; and wherein said outlet duct has a bottom end portion adjacent said primary transport channel, an external end portion opposed to said bottom end portion, and an upwardly inclined internal wall to allow particulate material within said outlet to be compressed by gravity when said primary transport channel and said outlet duct are filled with particulate material, and further said internal wall having a cross-section which is outwardly diverging toward said external end portion.

15. An apparatus for transporting particulate material according to claim 14 further comprising a pressure vent provided adjacent a junction between said outlet duct and said transport channel.

16. An apparatus for transporting particulate material according to claim 14 further comprising a pressure vent through said internal wall of said outlet duct.

17. An apparatus for transporting particulate material against a fluid pressure comprising:

a first movable surface defining a transport channel, an inlet and an outlet downstream of said inlet, said transport channel located between said inlet and said outlet, the first moving surface operable to move from said inlet towards said outlet;

an outlet duct defining a receptacle for holding, during the operation of the apparatus, a mass of the particulate material being transferred by the apparatus, so as to form a moving dynamic plug for inhibiting fluid from entering the primary transport channel from the outlet duct; and wherein said apparatus is operable to transport particulate material into a pressurized system containing pressurized fluid, and wherein the outlet duct has a first end coupled to the transport channel and a second end operable to be coupled to the pressurized system, said apparatus further comprising a non-return valve system for inhibiting pressurized fluid from entering into said transport channel through said outlet.

18. An apparatus for transporting particulate material comprising:

a housing having an inlet and an outlet, said outlet being upwardly angled to upwardly move particulate material therethrough;

a transport duct enclosed within said housing between said inlet and said outlet, said transport duct having a primary transport channel defined by first and second rotary disks movable relative to said housing between said inlet and said outlet towards said outlet and at least one arcuate wall extending between said inlet and said outlet, said first rotary disk having a first face, said second rotary disk having a second face which substantially opposes said first face, an outlet duct coupled to receive particulate material from said primary transport channel and defining a receptacle having an interior outlet channel which extends upward from the outlet of the transport channel and defines a cross-sectional area which diverges in the Upward direction for holding, during the operation of the apparatus, a mass of the particulate material being transferred by the apparatus, so as to form a moving dynamic plug for inhibiting fluid from entering the primary transport channel from the outlet duct.

19. An apparatus for transporting particulate material according to claim 18, further comprising drive means for moving said first and second rotary disks between said inlet and said outlet towards said outlet.

20. An apparatus for transporting particulate material according to claim 18, wherein said outlet duct has a bottom end portion adjacent said primary transport channel, an external end portion opposed to said bottom end portion, and an upwardly inclined internal wall.

21. An apparatus for transporting particulate material comprising:

a housing having an inlet and an outlet, said outlet being upwardly angled to upwardly move particulate material therethrough;

a transport duct enclosed within said housing between said inlet and said outlet, said transport duct having a primary transport channel defined by first and second rotary disks movable relative to said housing between said inlet and said outlet towards said outlet and at least one arcuate wall extending between said inlet and said outlet, said first rotary disk having a first face, said second rotary disk having a second face which substantially opposes said first face, an outlet duct coupled to receive particulate material from said primary transport channel and defining a receptacle for holding, during the operation of the apparatus, a mass of the particulate material being transferred by the apparatus, so as to form a moving dynamic plug for inhibiting fluid from entering the primary transport channel from the outlet duct; and wherein said first and second faces each having at least one discontinuity configured to define first and second transport facilitation zones contiguous with said primary transport channel such that particulate material within said first and second transport facilitation zones are contiguous with particulate material within said primary transport channel, each of said discontinuities having at least one downstream facing drive surface.

22. An apparatus for transporting particulate material comprising:

a housing having an inlet and an outlet, said outlet being upwardly angled to upwardly move particulate material therethrough;

a transport duct enclosed within said housing between said inlet and said outlet, said transport duct having a primary transport channel defined by first and second rotary disks movable relative to said housing between said inlet and said outlet towards said outlet and at least one arcuate wall extending between said inlet and said outlet, said first rotary disk having a first face, said second rotary disk having a second face which substantially opposes said first face, an outlet duct coupled to receive particulate material from said primary transport channel and defining a receptacle for holding, during the operation of the apparatus, a mass of the particulate material being transferred by the apparatus, so as to form a moving dynamic plug for inhibiting fluid from entering the primary transport channel from the outlet duct; and wherein said apparatus is operable to transport particulate material into a pressurized system containing pressurized fluid, and wherein the outlet duct has a first end coupled to the primary transport channel and a second end operable to be coupled to the pressurized system, said apparatus further comprising a non-return valve system for inhibiting pressurized fluid from entering into said transport channel through said outlet.

23. A method of operating an apparatus for transporting particulate solids, said apparatus having an inlet, a diverging, upward directed outlet duct, a transport channel between said inlet and said outlet duct, said outlet duct being coupled to a pressurized system, and a moving surface contiguous with said transport channel for moving particulate solids through said transport channel toward said outlet duct, said method comprising the steps of:

receiving particulate solids in said transport channel;

sequentially forming moving cumulative bridges of particulate material within said transport channel;

moving the bridged particulate material from the transport channel, upwardly through said diverging outlet duct so as to fill said outlet with particulate material; and sealing said pressurized system by said moving cumulative bridges of particulate material.

24. A method of operating an apparatus for transporting particulate solids, said apparatus having an inlet, an outlet duct, a transport channel between said inlet and said outlet duct, said outlet duct being coupled to a pressurized system., and a moving surface contiguous with said transport channel for moving particulate solids through said transport channel toward said outlet, said method comprising the steps of:

receiving particulate solids in said transport channel;

sequentially forming moving cumulative bridges of particulate material within said transport channel;

moving the bridged particulate material from the transport channel, upwardly through said outlet so as to fill said outlet with particulate material; and sealing said pressurized system by said moving cumulative bridges of particulate material; and wherein said pressurized system contains a pressurized fluid, and said method further comprises the step of venting said fluid adjacent a junction between said transport channel and said outlet duct.

25. A method of operating an apparatus for transporting particulate solids, said apparatus having an inlet, an outlet duct, a transport channel between said inlet and said outlet duct, said outlet duct being coupled to a pressurized system, and a moving surface contiguous with said transport channel for moving particulate solids through said transport channel toward said outlet, said method comprising the steps of:

receiving particulate solids in said transport channel;

sequentially forming moving cumulative bridges of particulate material within said transport channel;

moving the bridged particulate material from the transport channel, upwardly through said outlet so as to fill said outlet with particulate material; and sealing said pressurized system by said moving cumulative bridges of particulate material; and wherein said pressurized system contains a pressurized fluid, and said method further comprises the step of venting said fluid in said transport channel.

26. A system for transporting particulate material across a fluid pressure differential, the system comprising:

a first moveable surface defining a transport channel, an inlet and an outlet, said transport channel located between said inlet and said outlet, the first moveable surface operable to move between said inlet and said outlet, towards said outlet;

an outlet duct coupled to the outlet and cooperating with said transport channel to define a receptacle having an interior outlet channel which extends upward from the outlet of the transport channel and defines a cross-sectional area which diverges in the upward direction for holding, during the operation of the system, a mass of the particulate material being transferred by the system, said mass of particulate material forming a moving dynamic plug in at least one of the transport channel and the outlet duct, for inhibiting fluid from entering the transport channel from at least one of the inlet and the outlet duct.

27. A system as recited in claim 26, wherein the fluid pressure on the inlet side of the system is less than the fluid pressure on the outlets side of the system.

28. A system as recited in claim 26, wherein the fluid pressure on the inlet side of the system is greater than the fluid pressure on the outlet side of the system.

29. A system as recited in claim 26, wherein transport channel defines a cross-section area which diverges in the direction toward the outlet.

30. A system for transporting particulate material across a fluid pressure differential, the system comprising:

a first moveable surface defining a transport channel, an inlet and an outlet, said transport channel located between said inlet and said outlet, the first moveable surface operable to move between said inlet and said outlet, towards said outlet;

an outlet duct coupled to the outlet and cooperating with said transport channel to define a receptacle for holding, during the operation of the system, a mass of the particulate material being transferred by the system, said mass of particulate material forming a moving dynamic plug in at least one of the transport channel and the outlet duct, for inhibiting fluid from entering the transport channel from at least one of the inlet and the outlet duct; and wherein the at least one movable surface defines at least one undulation for engaging particulate material in the transport channel.

31. A method of operating an apparatus for transporting particulate material between a pressure fluid differential, said apparatus having an inlet provided in a first fluid pressure environment, a diverging, upward directed outlet duct having an outlet in a second fluid pressure environment, a transport channel between said inlet and said outlet duct, and a moving surface contiguous with said transport channel for moving particulate solids through said transport channel toward said outlet duct, said first fluid pressure environment having a fluid pressure different from that of the second fluid pressure environment, said method comprising the steps of:

receiving particulate solids in said transport channel;

sequentially forming moving cumulative bridges of particulate material within said transport channel;

moving the bridged particulate material from the transport channel to said outlet duct and upward through said diverging outlet duct; and forming a fluid pressure seal between the first and second fluid pressure environments with the bridged particulate material.

32. A method as recited in claim 31, wherein the fluid pressure in the first fluid pressure environment is less than the fluid pressure in the second fluid pressure environment.

33. A method as recited in claim 31, wherein the fluid pressure in the first fluid pressure environment is greater than the fluid pressure in the second fluid pressure environment.

34. A method of operating an apparatus for transporting particulate material between a pressure fluid differential, said apparatus having an inlet provided in a first fluid pressure environment, an outlet duct having an outlet in a second fluid pressure environment, a transport channel between said inlet and said outlet duct, and a moving surface contiguous with said transport channel for moving particulate solids through said transport channel toward said outlet duct, said first fluid pressure environment having a fluid pressure different from that of the second fluid pressure environment, said method comprising the steps of:

receiving particulate solids in said transport channel;

sequentially forming moving cumulative bridges of particulate material within said transport channel;

moving the bridged particulate material from the transport channel to said outlet duct and upward through said diverging outlet duct;

forming a fluid pressure seal between the first and second fluid pressure environments with the bridged particulate material; and wherein the moving surface defines at least one undulation and wherein the step of moving comprises the step of engaging particulate material in the transport channel with said at least one undulation of said moving surface.

35. A method of transporting particulate material across a pressure fluid differential, said method comprising the steps of:

arranging a particulate material transport channel between and coupling first and second fluid pressure environments, said first fluid pressure environment having a fluid pressure different from that of the second fluid pressure environment;

providing a transport channel inlet in fluid flow communication with the first fluid pressure environment;

providing a transport channel outlet in fluid flow communication with the second fluid pressure environment;

providing an upward directed, diverging outlet duct between the transport channel outlet and the second fluid pressure environment;

arranging a moving surface contiguous with said transport channel;

receiving particulate material within the transport channel through the transport channel inlet;

engaging the particulate material in the transport channel with a moving surface to transfer drive force from the moving surface to the particulate material;

forming a moving mass of particulate material within at least one of the transport channel and outlet duct;

moving the mass of particulate material upward through the diverging outlet duct; and forming a pressure seal between the first and second fluid pressure environments with the moving mass of particulate material.

36. A method as recited in claim 35, wherein the step of arranging a particulate material transport channel comprises the steps of:

determining a transport channel length L sufficient for holding a mass of particulate material suitable for forming a pressure seal between the first and second fluid pressure environments; and providing a transport channel of length L coupling the first and second pressure environments.

37. A method as recited in claim 35, wherein the fluid pressure in the first fluid pressure environment is less than the fluid pressure in the second fluid pressure environment.

38. A method as recited in claim 35, wherein the fluid pressure in the first fluid pressure environment is greater than the fluid pressure in the second fluid pressure environment.

39. A method as recited in claim 35, wherein the step of providing a transport channel comprises the step of providing a transport channel having a cross-section area which diverges in the direction from the inlet toward the outlet.

40. A method of transporting particulate material across a pressure fluid differential, said method comprising the steps of:

arranging a particulate material transport channel between and coupling first and second fluid pressure environments, said first fluid pressure environment having a fluid pressure different from that of the second fluid pressure environment;

providing a transport channel inlet in fluid flow communication with the first fluid pressure environment;

providing a transport channel outlet in fluid flow communication with the second fluid pressure environment;

providing an outlet duct between the transport channel outlet and the second fluid pressure environment;

arranging a moving surface contiguous with said transport channel;

receiving particulate material within the transport channel through the transport channel inlet;

engaging the particulate material in the transport channel with a moving surface to transfer drive force from the moving surface to the particulate material;

forming a moving mass of particulate material within at least one of the transport channel and outlet duct; and forming a pressure seal between the first and second fluid pressure environments with the moving mass of particulate material; and wherein the moving surface defines at least one undulation and wherein the step of engaging comprises the step of engaging particulate material in the transport channel with said at least one undulation of said moving surface.

* * * * *